US008820208B2

(12) United States Patent
Kim et al.

(10) Patent No.: US 8,820,208 B2
(45) Date of Patent: Sep. 2, 2014

(54) MINE DETECTOR DETACHABLY ATTACHED TO COMBAT BOOT

(75) Inventors: Ji Hoon Kim, Daejeon (KR); Jae Yong Jee, Daejeon (KR); Jin Chun Ju, Daejeon (KR); Kun Sung Ryu, Daejeon (KR); Yong Hwa Kim, Daejeon (KR); Sang Won Park, Daejeon (KR); Kang Wook Kim, Gwangju (KR)

(73) Assignee: Defense Agency for Technology and Quality, Daejeon (KR)

( * ) Notice: Subject to any disclaimer, the term of this patent is extended or adjusted under 35 U.S.C. 154(b) by 194 days.

(21) Appl. No.: 13/546,014

(22) Filed: Jul. 11, 2012

(65) Prior Publication Data

US 2014/0123840 A1 May 8, 2014

(30) Foreign Application Priority Data

Mar. 21, 2012 (KR) ..... 10-2012-0028640

(51) Int. Cl.
*G01V 3/15* (2006.01)
*F41H 11/136* (2011.01)

(52) U.S. Cl.
CPC ..... *F41H 11/136* (2013.01)
USPC ..... 89/1.13; 324/329

(58) Field of Classification Search
CPC ..... F41H 11/136
USPC ..... 89/1.13
See application file for complete search history.

(56) References Cited

U.S. PATENT DOCUMENTS

| | | | | | |
|---|---|---|---|---|---|
| 4,151,458 | A * | 4/1979 | Seager | 324/357 |
| 4,388,594 | A * | 6/1983 | Deskins et al. | 324/348 |
| 4,641,566 | A * | 2/1987 | Pomeroy | 89/1.13 |
| 5,665,934 | A * | 9/1997 | Tuttle et al. | 102/402 |
| 6,006,646 | A * | 12/1999 | Makris et al. | 36/96 |
| 6,101,916 | A * | 8/2000 | Panot et al. | 89/1.13 |
| 6,621,418 | B1 * | 9/2003 | Cayrol | 340/573.1 |
| 6,788,200 | B1 * | 9/2004 | Jamel et al. | 340/539.13 |
| 7,081,754 | B1 * | 7/2006 | Harris | 324/329 |
| 7,437,986 | B2 * | 10/2008 | Fuss et al. | 89/1.13 |
| 7,940,049 | B2 * | 5/2011 | Loubet | 324/326 |
| 2007/0044645 | A1 * | 3/2007 | Fuss et al. | 89/1.13 |
| 2011/0148419 | A1 * | 6/2011 | Cho et al. | 324/329 |

FOREIGN PATENT DOCUMENTS

| | | | |
|---|---|---|---|
| FR | 2762486 | A1 * | 10/1998 |
| FR | 2762487 | A1 * | 10/1998 |
| FR | 2813014 | A1 * | 2/2002 |
| GB | 2123559 | A * | 2/1984 |
| KR | 100261746 | B1 | 4/2000 |
| KR | 1020010021867 | A | 3/2001 |
| KR | 1020030075969 | A | 9/2003 |
| KR | 1020070098414 | A | 10/2007 |
| KR | 1020090121442 | A | 11/2009 |

* cited by examiner

*Primary Examiner* — Reginald Tillman, Jr.
(74) *Attorney, Agent, or Firm* — Hammer & Associates, P.C.

(57) ABSTRACT

Provided is a mine detector detachably attached to the combat boot, which includes a main body detachably attached to the combat boot, and provided with a power supply, a signal transmitting part and a signal receiving part, and a detection part detachably attached to the combat boot, and provided with an antenna connected to the main body.

13 Claims, 5 Drawing Sheets

MINE DETECTOR DETACHABLY ATTACHED TO COMBAT BOOT

CROSS-REFERENCE TO RELATED APPLICATION

This application claims priority to and the benefit of Korean Patent Application No. 10-2012-0028640, filed Mar. 21, 2012, the disclosure of which is incorporated herein by reference in its entirety.

BACKGROUND

1. Field of the Invention

The present invention relates to equipment for detecting mines in a minefield, and more particularly, to a mine detector detachably attached to a combat boot.

2. Discussion of Related Art

In general, a conventional mine detection technique includes a soldier holding a mine detector using his/her hands and scanning the ground to find a mine. Such a technique has an advantage that it can be used to safely find buried mines. However, in wartime or emergency, since a soldier cannot easily carry or use a gun in addition to the mine detector, another guard soldier must protect the soldier.

Korean Patent Registration No. 261746 discloses an apparatus for detecting presence of a mine or other buried explosives using gamma rays generated by a proton accelerator and a photonuclear resonance reaction of a nucleus of nitrogen, Korean Patent Registration No. 552931 discloses an apparatus for remotely detecting a mine in a compliant housing buried under the ground, Korean Patent Laid-open Publication No. 2003-75969 discloses an anti-tank mine detection system for an armored vehicle, Korean Patent Laid-open Publication No. 2006-112400 discloses a mine detector capable of identifying a radio frequency identification (RFID) tag is attached to a mine, Korean Patent Registration No. 856481 discloses a chemical sensor for detecting an aromatic nitro explosive, and Korean Patent Registration No. 1003734 discloses a driving apparatus for a mine detector. However, development of a technique by which the mine detector can be applied to a combat boot to improve combat power is needed.

SUMMARY OF THE INVENTION

In order to solve the problems, the present invention provides a mine detector detachably attached to a combat boot capable of improving combat power in combat or action.

Additional aspects and/or advantages of the invention will be set forth in part in the description which follows and, in part, will be obvious from the description, or may be learned by practice of the invention.

In order to accomplish the object, a mine detector detachably attached to a combat boot according to an embodiment of the present invention includes: a main body detachably installed at the combat boot, and provided with a power supply, a signal transmission part, and a signal receiving part; and a detection part detachably installed at the combat boot, and provided with an antenna connected to the main body.

According to an embodiment of the present invention, the main body may be installed at an ankle of the combat boot or a soldier's thigh through a fixing band and the detection part may be installed at a lower portion of the combat boot or on a sole of the combat boot.

According to an embodiment of the present invention, the antenna may have a shape corresponding to an edge shape of a sole of the combat boot.

According to an embodiment of the present invention, the detection part may further include a coupling member having a size and shape corresponding to a sole of the combat boot and configured to accommodate the antenna, and the detection part may further include a fixing band configured to fix the coupling member to the combat boot.

According to an embodiment of the present invention, the signal transmission part may include a signal generating part configured to generate a signal, a sampling part configured to sample the generated signal, and an amplifier configured to amplify the sampled signal.

According to an embodiment of the present invention, the signal receiving part may include an amplifier configured to amplify the received signal, a filter configured to remove noises from the received signal, and a sampling part configured to sample the signal passed through the filter.

According to an embodiment of the present invention, the main body may further include a data processing part configured to compare signals respectively sampled by the signal transmitting part and the signal receiving part to detect a mine; and the main body may further include a synchronization part configured to provide trigger signals to the signal generating part of the signal transmission part and the sampling part of the signal receiving part.

A mine detector detachably attached to a combat boot according to another embodiment of the present invention includes: a main body detachably installed at the combat boot, and provided with a power supply, a signal transmission part and a signal receiving part; and a detection part detachably installed at a lower portion of the combat boot, and provided with a first coupling member having a size and shape corresponding to a sole of the combat boot, a second coupling member fastened to the first coupling member toward a front side of the combat boot, and an antenna connected to the main body.

According to another embodiment of the present invention, the antenna may be mounted only on the second coupling member, and the antenna may include a low frequency antenna mounted on the first coupling member, and an ultra-wideband antenna mounted on the second coupling member.

According to another embodiment of the present invention, a plurality of air holes may be formed along an edge of the second coupling member.

According to another embodiment of the present invention, the main body may be installed at an ankle of the combat boot or a soldier's thigh through a fixing band, the first coupling member may be formed of a flexible member to be press-fitted into a lower portion of the combat boot, and the detection part may further include a fixing band configured to fix the first coupling member to the combat boot.

According to another embodiment of the present invention, the signal transmission part may include a first signal generating part configured to generate a low frequency signal, a first sampling part configured to sample the generated low frequency signal, a first amplifier configured to amplify the sampled low frequency signal, a second signal generating part configured to generate an ultra-wideband signal, a second sampling part configured to sample the generated ultra-wideband signal, and a second amplifier configured to amplify the sampled ultra-wideband signal.

According to another embodiment of the present invention, the signal receiving part may include an amplifier configured to amplify the received signal, a filter configured to remove noises from the received signal, and a sampling part configured to sample the signal passed through the filter, the main body may further include a data processing part configured to compare signals respectively sampled by the signal transmitting part and the signal receiving part to detect a mine, and the main body may further include a synchronization part configured to provide trigger signals to the signal generating part of the signal transmission part and the sampling part of the signal receiving part.

BRIEF DESCRIPTION OF THE DRAWINGS

The above and other objects, features and advantages of the present invention will become more apparent to those of ordinary skill in the art by describing in detail example embodiments thereof with reference to the attached drawings, in which.

DETAILED DESCRIPTION OF EXAMPLE EMBODIMENTS

Hereinafter, a mine detector detachably attached to a combat boot in accordance with the present invention will be described with reference to the accompanying drawings.

Figure 1:
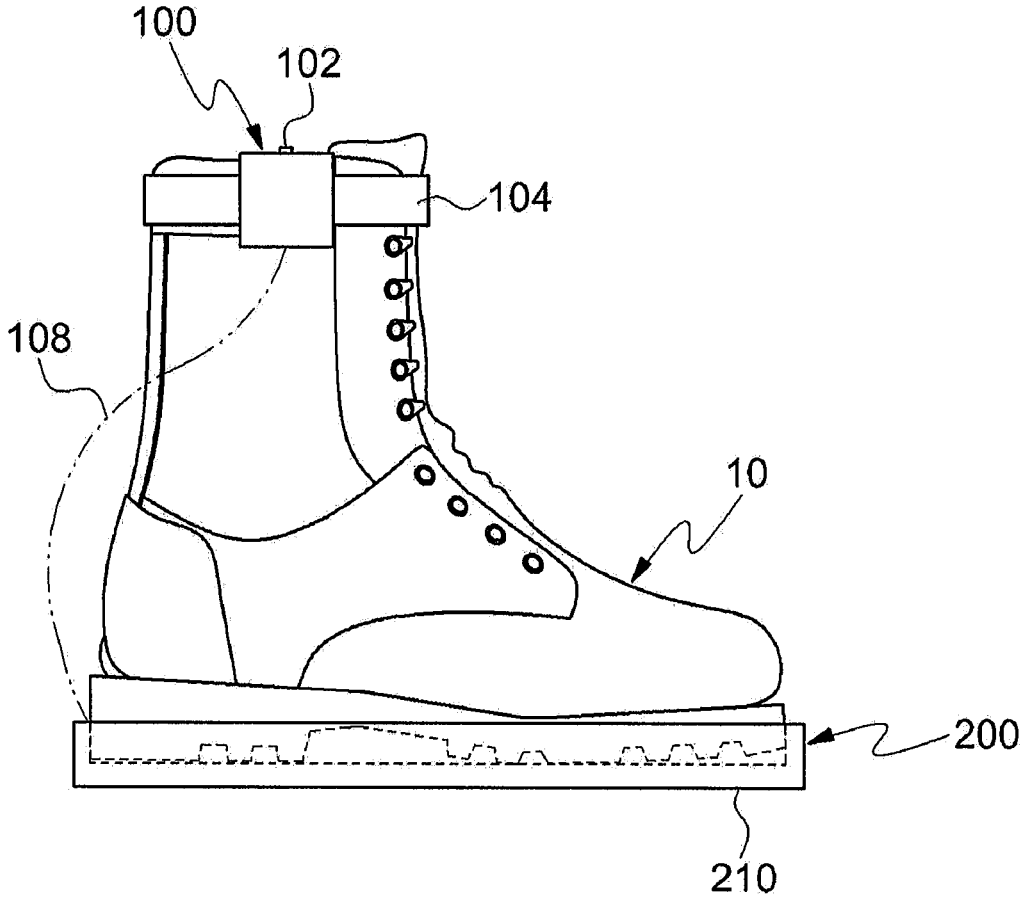
FIG. 1 is a side view of a mine detector in accordance with a first exemplary embodiment of the present invention.

FIG. 1 is a side view of a mine detector in accordance with a first exemplary embodiment of the present invention, and the mine detector includes a main body 100 detachably installed at a combat boot 10, and a detection part 200 connected to the main body 100.

The main body 100 may include a power supply, and may further include a signal transmitting part and a signal receiving part other than an antenna.

The main body 100 may be formed in a box shape, and may include a battery configured to supply power, a circuit board configured to perform transmission and reception of signals, and so on, which are disposed therein, and a switch 102 configured to turn on/off the power, which is disposed outside the main body 100. While the main body 100 is exemplarily shown as a box shape in the drawing, the main body is not limited thereto but may be manufactured in various shapes or may be manufactured in plural so that the power supply, the signal transmitting part and the signal receiving part can be separately manufactured.

Since the main body 100 may be heavy due to the battery and the circuit board, the main body 100 may be worn on the ankle of the combat boot 10 or a soldier's thigh to reduce a load of weight felt by the soldier.

The main body 100 may have a fixing band 104 so that the main body 110 can be worn on the ankle of the combat boot 10 or the soldier's thigh, and the fixing band 104 can be adjusted in length by a fixing member such as Velcro, a buckle, and so on, to fix the main body 100 to the combat boot 10.

The main body 100 may be connected to the detection part 200 through a connecting cable 108, the connecting cable 108 may supply power to or transmit/receive signals to/from the main body 100 and the detection part 200, and the connecting cable 108 may include one or a plurality of connecting wires.

As shown, while the connecting cable 108 may be installed outside the combat boot 10, the connecting cable 108 may also be installed inside the combat boot 10. In addition, in order to protect the connecting cable 108 from physical impact, the connecting cable 108 may be tightly fixed to the combat boot 10 using the fixing member such as Velcro, etc. However, in addition to wired transmission and reception through the connecting cable 108, wireless transmission and reception are also possible.

The detection part 200 may be detachably installed at the combat boot 10, preferably at a lower portion of the combat boot 10.

The detection part 200 may include an antenna connected to the main body 100, and may further include a coupling member 210 to mount the antenna thereon.

Figure 2:
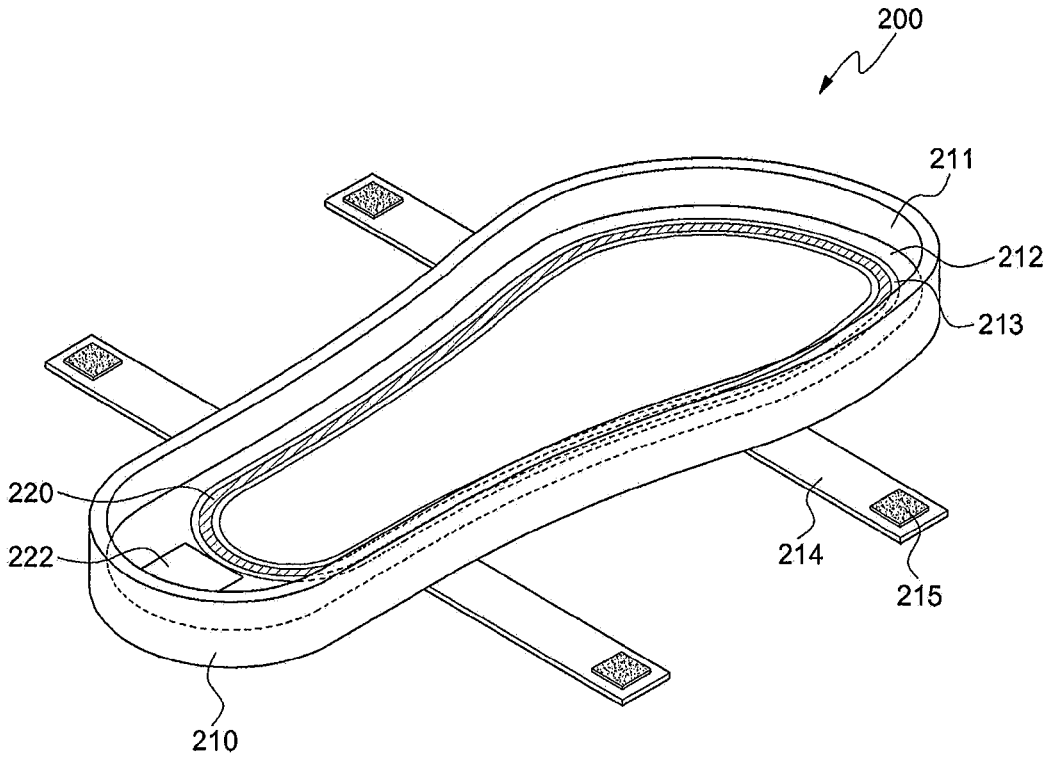
FIG. 2 is a perspective view of a detection part in accordance with a first exemplary embodiment of the present invention.

FIG. 2 is a perspective view of the detection part 200 in accordance with a first exemplary embodiment of the present invention, and the detection part 200 may include an antenna 220 and the coupling member 210 configured to fix the antenna 220 to the combat boot 10.

In order to minimize impact applied to the antenna 220 when a soldier moves, the coupling member 210 may have a size and shape corresponding to a sole of the combat boot 10, and for example, may be manufactured in a shape of a climbing iron. In addition, the coupling member 210 may have a coupling structure in which the coupling member 210 is disposed on a portion slightly protruding from the sole of the combat boot.

The coupling member 210 may be constituted by a sole 212 having a certain thickness, and an edge member 211 vertically extending from an edge of the sole 212.

The coupling member 210 may be formed of a flexible member such as rubber, etc., and in this case, the edge member 211 having flexibility may be press-fitted into a lower portion of the combat boot 10.

A guide member 213 is formed on an upper surface of the sole 212 to accommodate the antenna 220, and a connector 222 configured to connect the connecting cable 108 and the antenna 220 may be installed on the guide member 213.

The coupling member 210 may include a fixing band 214 to securely fix the detection part 200 to the combat boot 10. The fixing band 214 can length-adjustably fix the detection part 200 to the combat boot 10 by a fixing member 215, similar to the fixing band 104 of the main body 100. While the fixing member 215 is exemplarily provided as Velcro shown in FIG. 2, the fixing member 215 is not limited thereto but may be provided as a buckle, and so on.

In addition, the coupling member 210 may be partially installed on the bottom of the combat boot 10, rather than on the entire bottom, for example, only on a heel side in a horseshoe shape.

The antenna 220 may be used for chemical detection using a nuclear quadrupole resonance (NQR) system, metal detection using a mine detector (MD), and so on. The antenna 220 may be formed by rolling a long metal wire formed of copper, iron, etc., in a circular or oval shape. Here, the number of windings of the antenna 220 may be varied according to a frequency and a foot size.

The antenna 220 may be solely configured to transmit a signal or receive a signal through the same antenna, i.e., a transmitting antenna and a receiving antenna may be integrally formed with each other. For example, a low frequency signal may be generated from a signal generating part of the main body 100 to be transmitted through the antenna 220, and the signal reflected by the same antenna 220 can be received.

As shown in FIG. 2, similar to the coupling member 210, the antenna 220 may have a shape corresponding to the sole of the combat boot 10, and thus, a mine detection signal can be transmitted and received throughout the combat boot 10.

Fixing of the antenna 220 is not limited to that shown in FIG. 2 but may be performed in various ways. For example, the antenna may be fixed by a fixing member such as a cable tie, a fixing clip, and so on.

Figure 3:
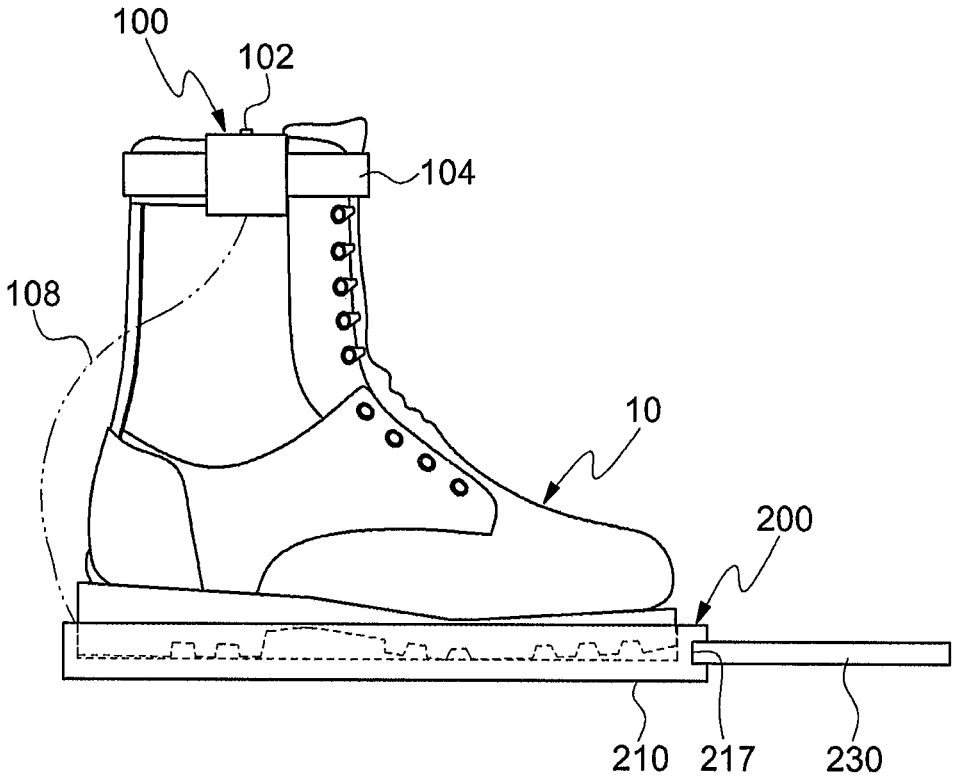
FIG. 3 is a side view of a mine detector in accordance with a second exemplary embodiment of the present invention.

FIG. 3 is a side view of a mine detector in accordance with a second exemplary embodiment of the present invention. Comparing the second embodiment with the first embodiment of FIG. 1, a second coupling member 230 is further installed to detect a wider region or in another way (an ultra-wideband antenna).

As shown, the second coupling member 230 may be mounted in a fastening groove 217 formed in front of a first coupling member 210. However, a coupling structure of the first coupling member 210 and the second coupling member 230 is not limited thereto but may be varied in various ways. In addition, the second coupling member 230 may be horizontally installed with respect to the combat boot 10 or the ground, or may be installed to form a certain angle with respect to the combat boot 10 or the ground.

Figure 4:
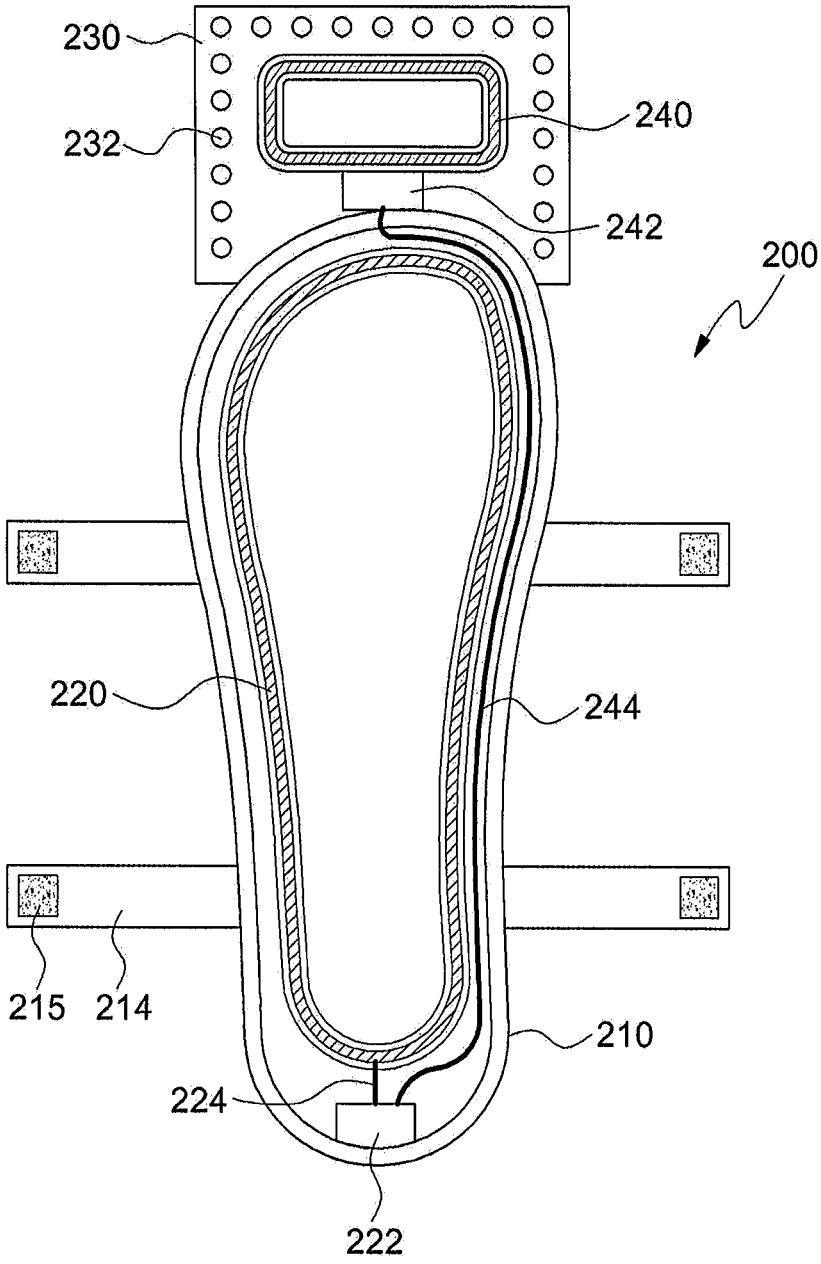
FIG. 4 is a cross-sectional view of a detection part in accordance with a second exemplary embodiment of the present invention.

FIG. 4 is a cross-sectional view of the detection part 200 in accordance with a second exemplary embodiment of the present invention. The detection part 200 may include the first coupling member 210 and the second coupling member 230, and further, a first antenna 220 and a second antenna 240.

As described above, the first coupling member 210 may be detachably attached to a lower portion of the combat boot 10, have a size and shape corresponding to the sole of the combat boot 10, and include a fixing band 214 having a fixing member 215.

While the second coupling member 230 may be manufactured in a plate shape projecting forward from the combat boot 10, fastened to the first coupling member 210 and including an antenna installed therein, and a shape of the second coupling member 230 is not limited to the drawing but may be variously modified.

According to the embodiment, while the antenna may be mounted on the second coupling member 230 only, as shown in FIG. 4, the antenna may also include a first antenna 220 for a low frequency mounted on the first coupling member 210, and a second antenna 240 for an ultra-wideband mounted on the second coupling member 230.

As shown, the first antenna 220 and the second antenna 240 may be connected in parallel to the main body 100. That is, the first antenna 220 may be connected to the main body from a first connector 222 through a first connecting line 224, and the second antenna 240 may be connected to the main body from a second connector 242 through a second connecting line 244 separated from the first connector 222.

Since the second coupling member 230 is separately installed in front of the combat boot 10, a wearer may receive air resistance and experience inconvenience when he/she moves. In order to solve this problem, a plurality of air holes 232 may be formed along an edge of the second coupling member 230 to reduce the air resistance, facilitating movement of the wearer.

The shape and the coupling structure of the first coupling member 210 and the second coupling member 230, and the connecting method and the fixing structure of the first antenna 220 and the second antenna 240 are not limited to the drawings but may be variously modified.

Figure 5:
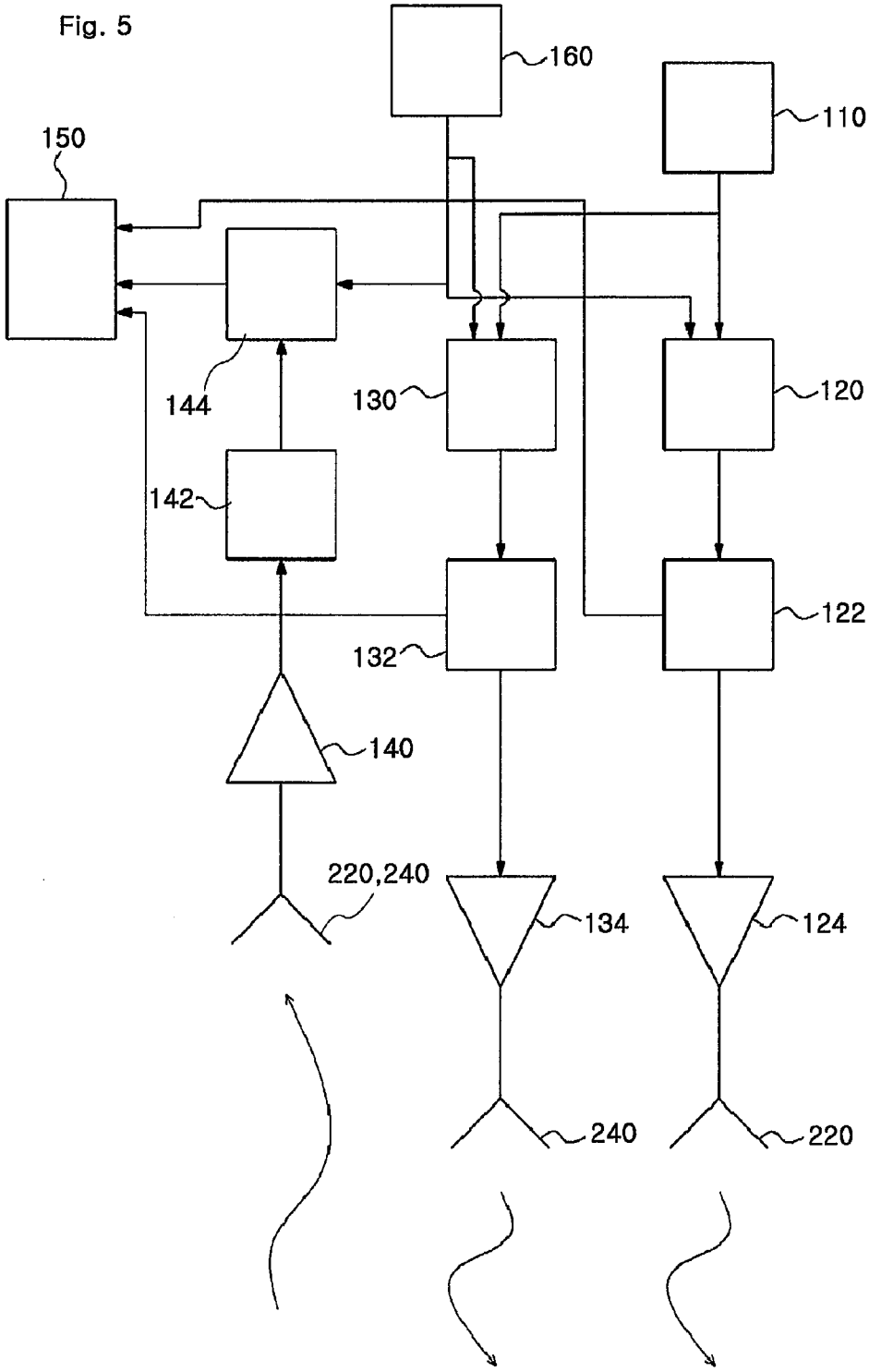
FIG. 5 is a block diagram of the mine detector in accordance with a second exemplary embodiment of the present invention.

FIG. 5 is a block diagram of the mine detector in accordance with a second exemplary embodiment of the present invention. The mine detector may employ ultra-wideband radar, a metal detector, a chemical detector, or a combination thereof, and may inform of presence of a mine through sound or light.

A power supply 110 may be constituted by a battery, for example, a primary battery such as a dry cell, a secondary battery such as a rechargeable battery, and so on.

According to the embodiment, the signal transmission part may include a first signal generating part 120 configured to generate a low frequency signal, a first sampling part 122 configured to sample the generated low frequency signal, a first amplifier 124 configured to amplify the sampled low frequency signal, a second signal generating part 130 configured to generate an ultra-wideband signal, a second sampling part 132 configured to sample the generated ultra-wideband signal, and a second amplifier 134 configured to amplify the sampled ultra-wideband signal. In addition, while not shown, the signal transmission part may include a filter according to necessity.

The signal receiving part may include an amplifier 140 configured to amplify the received signal, a filter 142 configured to remove noises from the received signal, and a third sampling part 144 configured to sample the signal passing through the filter 142. The amplifier 140 may be a low noise amplifier (LNA), and the third sampling part 144 may be an analog to digital converter.

In addition, a data processing part 150 configured to compare the signals sampled in the signal transmitting part and the signal receiving part, respectively, to detect a mine may be provided, and a synchronization part 160 configured to provide a trigger signal to a signal generating part of the signal transmission part and a sampling part of the signal receiving part may be provided.

Briefly describing a mine detection process shown in FIG. 5, first, power from the power supply 110 is supplied to the two signal generating parts 120 and 130, the first signal generating part 120 generates a low frequency signal corresponding to the first antenna 220, and the second signal generating part 130 generates a signal having a radio frequency corresponding to the second antenna 240 and a wide bandwidth. Then, after the signals are sampled in the first sampling part 122 and the second sampling part 132 to be synchronized, the signals are radiated through the first antenna 220 and the second antenna 240 via the first amplifier 124 and the second amplifier 134, respectively. The radiated signal is reflected to be returned, passes through the filter 142 via the amplifier 140 to be sampled in the third sampling part 144, and is compared with the signal sampled by the two signal generating parts 120 and 130 in the data processing part 150 to detect a mine. For example, when a peak is generated at a received signal in comparison with the transmitted signal, presence of the mine is determined, and an alarm is issued through an alarm sound and/or flickering of light.

FIG. 5 is the diagram of the mine detector in accordance with a second exemplary embodiment of the present invention shown in FIGS. 3 and 4. When the mine detector in accordance with a first exemplary embodiment of the present invention shown in FIGS. 1 and 2 is provided, the second signal generating part 130, the second sampling part 132, the second amplifier 134 and the second antenna 240 may be omitted.

Hereinafter, according to still another embodiment of the present invention, a case in which ultra-wideband radar is employed as a mine detection means and a pseudo random noise signal or an impulse signal is used as a signal will be described.

The signal transmission part generates a pseudo random noise signal used in target detection to be radiated, and for this, may include the signal generating parts 120 and 130, the filter, the sampling parts 122 and 132, the amplifiers 124 and 134, and the antennas 220 and 240.

The signal generating parts 120 and 130 may generate a pseudo random noise signal or an impulse signal. The pseudo random noise signal may be a gold code in which a pseudo noise code (hereinafter referred to as a PN code) and a plurality of pseudo noise codes are coupled.

The PN code, which is one of periodical codes, is a code in which values at each moment of one period become a distribution in accordance with a random distribution. While the PN code has characteristics similar to a random noise signal, a precise waveform can be obtained to easily process demodulation, etc., of an original signal. Similar to the random noise signal, the PN code may have advantages such as improvement in precision with respect to a target, reduction in influence by a natural environment, increase in detection probability with respect to the target, improvement in continuous observation performance with respect to the detected target, and high confidentiality to make it difficult for an enemy to detect the PN code.

While the gold code means a code generated by adding outputs of two bandwidth diffusion code generators of a bandwidth diffusion system using a Modulo-2, in this specification, the gold code may refer to a code generated by coupling a plurality of PN codes. As the PN codes are coupled, the gold code also has the same advantages as the PN code. The gold code generated by coupling the plurality of PN codes may be used as the pseudo random noise signal.

Since the pseudo random noise signal has properties of a random noise signal, there may be a signal of an undesired bandwidth including a direct current (DC) signal, a radio frequency element, etc. The DC signal cannot be radiated through the antenna, and the signal in the undesired bandwidth should not be radiated. Accordingly, there is a need to remove the DC signal and the signal in the undesired bandwidth (due to characteristics of the ultra-wideband radar, a radio frequency element corresponds thereto), and for this, the filter may be used.

The filter may include a DC blocking part configured to remove the DC signal included in the pseudo random noise signal, and a low pass filter (LPF) configured to block the undesired radio frequency signal. In this case, the DC blocking part may be disposed at a front end of the LPF, or may be disposed at a rear end of the LPF through an appropriate circuit configuration.

The DC blocking part can remove the DC signal included in the pseudo random noise signal at a frequency axis, and differentiate the pseudo random noise signal at a time axis.

The LPF may have an effect of smoothing the signal having an impulse shape passed through the DC blocking circuit to smoothly perform radiation through the antenna, in addition to an effect of blocking the undesired radio frequency signal.

The pseudo random noise signal passed through the filter can be radiated to the outside through the antennas 220 and 240. Here, the amplifiers 124 and 134 may be disposed between the filter and the antennas 220 and 240 to amplify the output signal of the filter part to be appropriate for radiation.

The sampling parts 122 and 132 can sample the pseudo random noise signals passed through the filter to store the signals as first and second digital signals. For this, the sampling parts 122 and 132 may include storage parts configured to store the first and second digital signals. Of course, the storage parts may be separately provided from the sampling parts 122 and 132.

The signal receiving part receives the pseudo random noise signal reflected by a target, and for this, may include the antennas 220 and 240, the amplifier 140, the filter 142 and the third sampling part 144.

The antennas 220 and 240 receive the pseudo random noise signal reflected and returned by the target, and according to the configuration, an antenna of a radar signal receiving part may be integrally formed with an antenna of a radar signal transmission part.

The filter 142 may include the LPF configured to remove noises from the pseudo random noise signal having various noises introduced during a propagation process and to block a typically undesired radio frequency signal.

Since the pseudo random noise signal received by the antennas 220 and 240 may be weak, the signal may be amplified to a certain level for appropriate processing in the filter 142 and the third sampling part 144, which are disposed at the rear end. Here, the amplifier 140 may be disposed between the filter 142 and the antennae 220 and 240 to amplify the level at this time.

The third sampling part 144 can sample the pseudo random noise signal passed through the filter 142 to store the signal as a third digital signal. For this purpose, the third sampling part 144 may include a storage part configured to store the third digital signal. Of course, the storage part may also be separately provided from the third sampling part 144.

The data processing part 150 can perform matched filtering of the first and second digital signals transmitted from the first and second sampling parts 122 and 132 and the third digital signal transmitted from the third sampling part 144 to obtain information of the target. Specifically, the data processing part 150 can perform the matched filtering to obtain the target information by performing correlation of the first and second digital signals and the third digital signal at a time region or by performing a fast Fourier transform (FFT) at a frequency region.

Since the ultra-wideband radar has characteristics of noise radar, a sampling time at the first and second sampling parts 122 and 132 and the third sampling part 144 should be delayed in comparison with generation of the pseudo random noise signal at the signal generating parts 120 and 130.

For this, when the radar signal transmission part includes the first and second signal generating parts 120 and 130 configured to generate the pseudo random noise signal and the first and second sampling parts 122 and 132 configured to sample the pseudo random noise signal, and the radar signal receiving part includes the third sampling part 144 configured to sample the pseudo random noise signal passed through the filter 142, the synchronization part 160 configured to provide a trigger signal to the first signal generating part 120, the second signal generating part 130, the first sampling part 122, the second sampling part 132 and/or the third sampling part 144 may be installed.

Here, the synchronization part 160 can provide the trigger signals to the sampling parts 122, 132 and 144 at a delayed time in comparison with the trigger signals provided to the signal generating parts 120 and 130, and for this, may include a delay part configured to delay the trigger signals provided to the signal generating parts 120 and 130 and provide the delayed trigger signals to the sampling parts 122, 132 and 144, respectively.

The delayed time of the trigger signal, i.e., a time difference between the trigger signals provided to the signal generating parts 120 and 130 and the trigger signals provided to the sampling parts 122, 132 and 144, may be gradually increased or reduced as generation of the pseudo random noise signals at the signal generating parts 120 and 130 is repeated. Accordingly, the entire waveform of the received random pseudo noise signal can be sequentially matched and filtered according to the transmitted random pseudo noise signal. While a subject of the matching and filtering at this time has characteristics of the random noise signal, which is the pseudo random noise signal, since the same signal is repeatedly generated with respect to each of the sampling parts at predetermined time intervals, recovery of the original signal is possible even when each of the sampling parts is constituted by a low-speed sampler. That is, as each of the sampling parts is constituted by the low-speed sampler, which is relatively inexpensive, productivity of the ultra-wideband radar can be improved.

As can be seen from the foregoing, as the mine detector in accordance with the present invention detachably attached to the combat boot is provided, a soldier can detect a mine while armed in combat. In addition, since the mine detector is detachably attached to the combat boot, one mine detector can be used in several combat boots, and costs can be reduced.

Since the mine detector in accordance with the present invention can be detachably attached to the combat boot, unlike the conventional mine detector, the soldier can use the exchangeable mine detector while armed in combat, and thus, combat power of the military can be improved.

While the invention has been shown and described with reference to certain example embodiments thereof, it will be understood by those skilled in the art that various changes in form and details may be made therein without departing from the spirit and scope of the invention as defined by the appended claims.

What is claimed is:

1. A mine detector detachably attached to a combat boot, comprising:

a main body detachably installed at the combat boot, and provided with a power supply, a signal transmission part, a signal receiving part, and a data processing part configured to compare signals respectively sampled by the signal transmitting part and the signal receiving part to detect a mine; and a detection part detachably installed at a lower portion of the combat boot, and provided with a first coupling member having a size and shape corresponding to a sole of the combat boot, a second coupling member fastened to the first coupling member toward a front side of the combat boot, and an antenna configured to transmit/and receive a signal to/from and the signal transmitting part and the signal receiving part, wherein a plurality of air holes are formed along an edge of the second coupling member.

2. The mine detector according to claim 1, wherein the antenna has a shape corresponding to an edge shape of a sole of the combat boot.

3. The mine detector according to claim 1, wherein the signal transmission part comprises a signal generating part configured to generate a signal, a sampling part configured to sample the generated signal, and an amplifier configured to amplify the sampled signal.

4. The mine detector according to claim 3, wherein the signal receiving part comprises an amplifier configured to amplify the received signal, a filter configured to remove noises from the received signal, and a sampling part configured to sample the signal passed through the filter.

5. The mine detector according to claim 4, wherein the main body further comprises a synchronization part configured to provide trigger signals to the signal generating part of the signal transmission part and the sampling part of the signal receiving part.

6. The mine detector according to claim 1, wherein the antenna is mounted only on the second coupling member.

7. The mine detector according to claim 1, wherein the antenna comprises a low frequency antenna mounted on the first coupling member, and an ultra-wideband antenna mounted on the second coupling member.

8. The mine detector according to claim 1, wherein the main body is installed at an ankle of the combat boot or a soldier's thigh through a fixing band.

9. The mine detector according to claim 1, wherein the first coupling member is formed of a flexible member to be press-fitted into a lower portion of the combat boot.

10. The mine detector according to claim 1, wherein the detection part further comprises a fixing band configured to fix the first coupling member to the combat boot.

11. The mine detector according to claim 7, wherein the signal transmission part comprises a first signal generating part configured to generate a low frequency signal, a first sampling part configured to sample the generated low frequency signal, a first amplifier configured to amplify the sampled low frequency signal, a second signal generating part configured to generate an ultra-wideband signal, a second sampling part configured to sample the generated ultra-wideband signal, and a second amplifier configured to amplify the sampled ultra-wideband signal.

12. The mine detector according to claim 11, wherein the signal receiving part comprises an amplifier configured to amplify the received signal, a filter configured to remove noises from the received signal, and a sampling part configured to sample the signal passed through the filter.

13. The mine detector according to claim 12, wherein the main body further comprises a synchronization part configured to provide trigger signals to the signal generating part of the signal transmission part and the sampling part of the signal receiving part.

* * * * *